US009663880B2

(12) United States Patent
Inagaki

(10) Patent No.: US 9,663,880 B2
(45) Date of Patent: May 30, 2017

(54) METHOD FOR MANUFACTURING KNITTED GLOVE

(71) Applicant: SHOWA GLOVE CO., Hyogo (JP)

(72) Inventor: Toshio Inagaki, Hyogo (JP)

(73) Assignee: Showa Glove Co., Hyogo (JP)

( * ) Notice: Subject to any disclaimer, the term of this patent is extended or adjusted under 35 U.S.C. 154(b) by 224 days.

(21) Appl. No.: 14/018,891

(22) Filed: Sep. 5, 2013

(65) Prior Publication Data

US 2014/0076001 A1 Mar. 20, 2014

(30) Foreign Application Priority Data

Sep. 19, 2012 (JP) ..... 2012-206200

(51) Int. Cl.

| | |
|---|---|
| ***D04B 1/22*** | (2006.01) |
| ***D04B 15/36*** | (2006.01) |
| ***D04B 35/04*** | (2006.01) |
| ***D04B 1/28*** | (2006.01) |
| ***D04B 15/78*** | (2006.01) |
| ***D04B 7/34*** | (2006.01) |
| ***D04B 15/82*** | (2006.01) |

(52) U.S. Cl.

CPC ..... *D04B 15/36* (2013.01); *D04B 1/28* (2013.01); *D04B 7/34* (2013.01); *D04B 15/78* (2013.01); *D04B 15/82* (2013.01); *D04B 35/04* (2013.01)

(58) Field of Classification Search

CPC ... D04B 7/14; D04B 7/34; D04B 9/16; D04B 9/58; D04B 15/68; D04B 15/70; D04B 15/82; D04B 15/36; D04B 1/28

USPC ..... 66/65, 74, 78, 216, 222, 20, 38, 40, 45, 66/68, 75.1, 75.2

See application file for complete search history.

(56) References Cited

U.S. PATENT DOCUMENTS 2,188,295 A * 1/1940 Getaz ..... D04B 1/26 66/41

3,715,897 A * 2/1973 Hadam ..... D04B 15/365 66/75.2

(Continued)

FOREIGN PATENT DOCUMENTS

| | | |
|---|---|---|
| CN | 2292818 | 9/1998 |
| CN | 2505494 | 8/2002 |

(Continued)

*Primary Examiner* — Danny Worrell
*Assistant Examiner* — Carolyn W Davis
(74) *Attorney, Agent, or Firm* — Norris McLaughlin & Marcus, P.A.

(57) ABSTRACT

A knitting machine that is capable of: knitting a knitted product of high gauge while effectively preventing increase in the number of components in a needle selection mechanism, and performing knitting methods such as inlaid knitting easily and reliably. The knitting machine comprises a plurality of knitting needles each of which have a protrudingly provided butt and which are arranged substantially parallel to each other so as to be able to perform a knitting operation independently, a plurality of selectors that move the knitting needles toward a protruding side of the butt, and a carriage having a cam groove along which the butt of the knitting needle, which has been moved by the selector to the side where the butt is protrudingly provided, can slide, in which the selector moves at least two adjacent knitting needles simultaneously to the side where the butt is protrudingly provided.

3 Claims, 8 Drawing Sheets

(56) References Cited

U.S. PATENT DOCUMENTS

| | | | | |
|---|---|---|---|---|
| 4,041,732 | A * | 8/1977 | Krause | D04B 15/70 66/75.2 |
| 4,100,767 | A * | 7/1978 | Schieber | D04B 15/78 66/75.2 |
| 4,294,085 | A * | 10/1981 | Trautner | D04B 15/365 66/75.1 |
| 4,644,763 | A * | 2/1987 | Kohler | D04B 15/68 66/75.2 |
| 7,469,561 | B2 | 12/2008 | Krauss | |
| 2002/0166346 | A1 * | 11/2002 | Pernick | D04B 9/16 66/8 |
| 2008/0184745 | A1 | 8/2008 | Krauss | |

FOREIGN PATENT DOCUMENTS

| | | |
|---|---|---|
| CN | 201012953 | 1/2008 |
| CN | 101476197 | 7/2009 |
| CN | 201704501 | 1/2011 |
| CN | 102493113 | 6/2012 |
| EP | 1 911 867 | 4/2008 |
| JP | S36-11146 | 5/1961 |
| JP | S48-9380 | 3/1973 |
| JP | S50-132249 | 4/1974 |
| JP | 2010242245 | 10/2010 |

* cited by examiner (A)

(B)

METHOD FOR MANUFACTURING KNITTED GLOVE

BACKGROUND OF THE INVENTION

Field of Invention

The present invention relates to a knitting machine and a method for manufacturing a glove.

Description of the Related Art

As a knitting machine for manufacturing a glove, a weft knitting machine is widely used. In a weft knitting machine that is conventionally used, a large number of needle plates is provided upright on a needle bed to thereby form a large number of needle grooves, the needle grooves storing a knitting needle which reciprocates to knit a knit fabric.

Each knitting needle of the above described weft knitting machine is stored in the single needle groove and is provided with a hook on a tip end thereof. In addition, a butt is provided on an upper portion of each knitting needle in a protruding manner, the butt sliding along the cam groove to thereby allow the knitting needle to reciprocate. Furthermore, in the weft knitting machine of this sort, a needle selection mechanism is provided for selecting a knitting needle used for each knitting operation, the needle selection mechanism having a selector that lifts the knitting needle. In other words, among a large number of knitting needles, only knitting needles which are used for the knitting operation are elevated by the selector, allowing the butts of these knitting needles to slide along the cam grooves while preventing the butts of other knitting needles from sliding along the cam grooves, to thereby reciprocate only the knitting needles which are used for the knitting operation. And then, by engaging a knitting thread with the hook of the reciprocating knitting needle, a stitch loop is formed to thereby knit a knit fabric.

With regard to the knit fabric thus knitted, in order to make a thinner fabric and to give a superior texture, it is preferable to increase gauge and make stitches finer; however, in order to increase gauge, a knitting operation using a large number of knitting needles is required. In such a case of using a large number of knitting needles, the number of components of the needle selection mechanism increases accordingly, leading to an increased number of components of the needle selection mechanism and increased cost. Therefore, increase in gauge, especially up to 20 gauge or so, increases the cost per unit of the knitting machine and makes the knitting machine less cost effective. This makes it practically difficult to increase the gauge.

In view of the above problems, the present inventors have invented a knitting machine in which hooks in one needle groove operate integrally, as disclosed in Japanese Unexamined Patent Application Publication No. 2012-12757. According to the knitting machine disclosed in the Publication, since a single jack can control a plurality of hooks, it is possible to knit a fine-stitched knitted product while effectively suppressing increase in number of components of the needle selection mechanism and the like.

However, in the knitting machine disclosed in the above-mentioned Publication, since the hooks in one needle groove operate integrally, it is difficult for the hooks to individually operate and, for example, inlaid knitting, in which a rubber thread passes through stitch loops, has been difficult. Therefore, in the knitting machine disclosed in the above-mentioned Publication, it has been difficult to knit an elastic portion of a glove, for example.

The present invention has been made in view of the above-mentioned circumstances, and an objective of the present invention is to provide a knitting machine that is capable of knitting a fine stitched knitted product of high gauge while effectively preventing increase in the number of components in a needle selection mechanism, and performing a desired knitting method easily and reliably, as well as a method for manufacturing a glove using the knitting machine.

SUMMARY OF THE INVENTION

A knitting machine according to the present invention that has been made for solving the above-mentioned problems includes:

a plurality of knitting needles each of which has a protrudingly provided butt and which are arranged substantially parallel to each other so as to be able to perform a knitting operation independently;

a plurality of selectors that move the knitting needles to the side where the butt is protrudingly provided; and a carriage having a cam groove along which the butt of the knitting needle moved by the selector to the side where the butt is protrudingly provided can slide, wherein the selector moves at least two adjacent knitting needles simultaneously to the side where the butt is protrudingly provided.

In the present knitting machine, the selector can move at least two adjacent knitting needles simultaneously to the side where the butt is protrudingly provided. Therefore, by sliding the butts which have been moved to the protruding side, along the cam grooves, adjacent knitting needles can be simultaneously operated to knit. A knitted product of high gauge can thus be knitted easily and reliably while avoiding the number of components, such as the selector, from increasing in the needle selection mechanism. In addition, in the present knitting machine, the plurality of knitting needles can operate independently and any desired knitting method can be performed by controlling each of the knitting needles. This allows, for example, inlaid knitting to be performed easily and reliably.

The present knitting machine can employ a configuration of further comprising: a plurality of needle plates that are provided substantially parallel to each other and that constitute needle grooves; and a partitioning plate that is provided between the needle plates to be substantially parallel to the needle plate and that partitions the needle groove, wherein each of the knitting needles is stored in a portion partitioned by the partitioning plate so as to be able to perform a knitting operation; and the selector is provided between the needle plates in such a way as not to be in contact with the partitioning plate. By thus storing each knitting needle in the portion partitioned by the partitioning plate (between the partitioning plate and the needle plate, or between the needle plates), a stable knitting operation by the knitting needle is realized. In addition, since the selector is provided in such a way as not to be in contact with the partitioning plate, the selector can move a plurality of knitting needles between the needle plates simultaneously to the side where the butt is protrudingly provided easily and reliably.

The present knitting machine can employ a configuration in which the knitting needles to be simultaneously moved by the selector to the side where the butt is protrudingly provided have butts of different heights; and the cam groove has a height selection portion along which, of the knitting needles moved by the selector to the side where the butt is protrudingly provided, a shorter butt does not slide but a taller butt slides. With such a configuration, in a state in which the plurality of knitting needles has been moved simultaneously by the selector to the side where the butt is protrudingly provided, only the taller butt slides along the height selection portion of the cam groove but the shorter butt does not. Therefore, inlaid knitting, for example, can be realized by performing a knitting operation by using only the knitting needles having the taller butts while the knitting needles having the shorter butts are kept at rest.

In a case where the above described configuration is employed, a configuration in which the knitting needle has at least two butts along a longitudinal direction thereof, a first butt of the at least two butts being of a different height from a butt of an adjacent knitting needle and a second butt of the at least two butts being of a substantially same height as a butt of the adjacent knitting needle; and the carriage has a plurality of the cam grooves corresponding to the at least two butts in the longitudinal direction of the knitting needle, a first cam groove of the plurality of the cam grooves corresponding to the first butt has the height selection portion can be employed. This allows a knitting operation only with the knitting needles having the taller butts by sliding the taller first butt along the height selection portion of the first cam grooves, to thereby realize inlaid knitting easily and reliably. In addition, by sliding the second butt along a second cam groove of the plurality of the cam grooves, the knitting needles that have been moved to the side where the butt is protrudingly provided by the selector can perform a knitting operation, to thereby form stitch loops easily and reliably.

In a case in which the above described configuration is employed, a configuration in which the knitting needle has a stem and a jack, the stem having a hook and the jack being connected to the stem and in contact with the selector; the stem has a stem butt as the first butt; and the jack has a jack butt as the second butt can be employed. In such a configuration, by sliding a taller stem butt along the height selection portion, a knitting operation only with the knitting needles with the taller butt is possible, to thereby realize inlaid knitting. In addition, by sliding the jack butt along the second cam grooves, the knitting needles that have been moved to the side where the butt is protrudingly provided by the selector can perform a knitting operation, to thereby form stitch loops.

A method of manufacturing a knitted product according to the present invention is a method using the knitting machine that is configured as described above. A glove of high gauge with fine stitches that is easily and reliably knitted by a desired knitting method can thus be obtained. In addition, since the needle selection mechanism does not require a large number of components, a cost effective glove can be obtained.

In addition, the method comprises an inlaid knitting process in which a rubber thread is carried by a single knitting needle or a plurality of knitting needles by letting a taller butt slide along the height selection portion in the cam groove, to thereby allow formation of an elastic portion of a glove by inlaid knitting.

As described above, the present knitting machine and the present method of manufacturing a glove allow knitting of a fine stitched knitted product of high gauge while effectively preventing increase in the number of components in a needle selection mechanism; and realize inlaid knitting easily and reliably.

DESCRIPTION OF THE PREFERRED EMBODIMENTS

Figure 1:
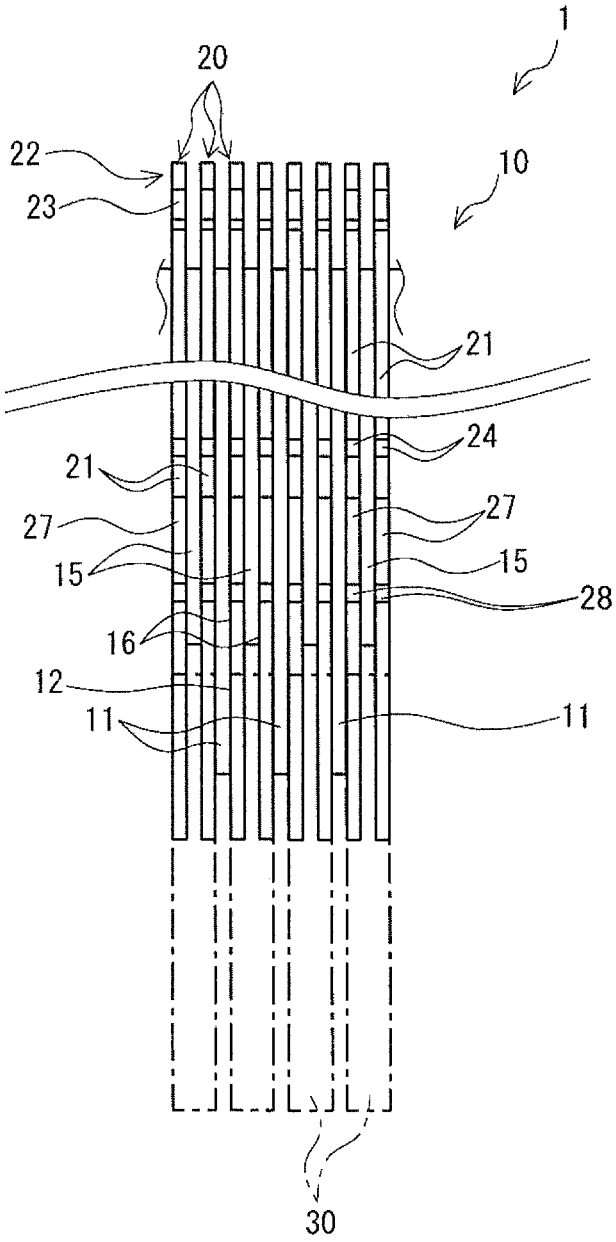
FIG. 1 is an illustration of a weft knitting machine according to an embodiment of the present invention, as a schematic enlarged view of a main part of a needle bed viewed from a normal direction.

Preferred embodiments of the present invention are described hereinafter with reference to the attached drawings as appropriate. First, a weft knitting machine of a flat knitting machine used for manufacturing a glove is described as an embodiment of the knitting machine according to the present invention.

[Weft Knitting Machine]

A weft knitting machine 1 comprises a plurality of knitting needles 20 having a hook 22 on a tip end thereof for performing a knitting operation, a needle selection mechanism for selecting the knitting needles 20 used for the knitting operation, and a carriage 40 having cam grooves 47, 48 for forcing the selected knitting needles 20 to perform the knitting operation.

<Needle Bed>

Figure 2:
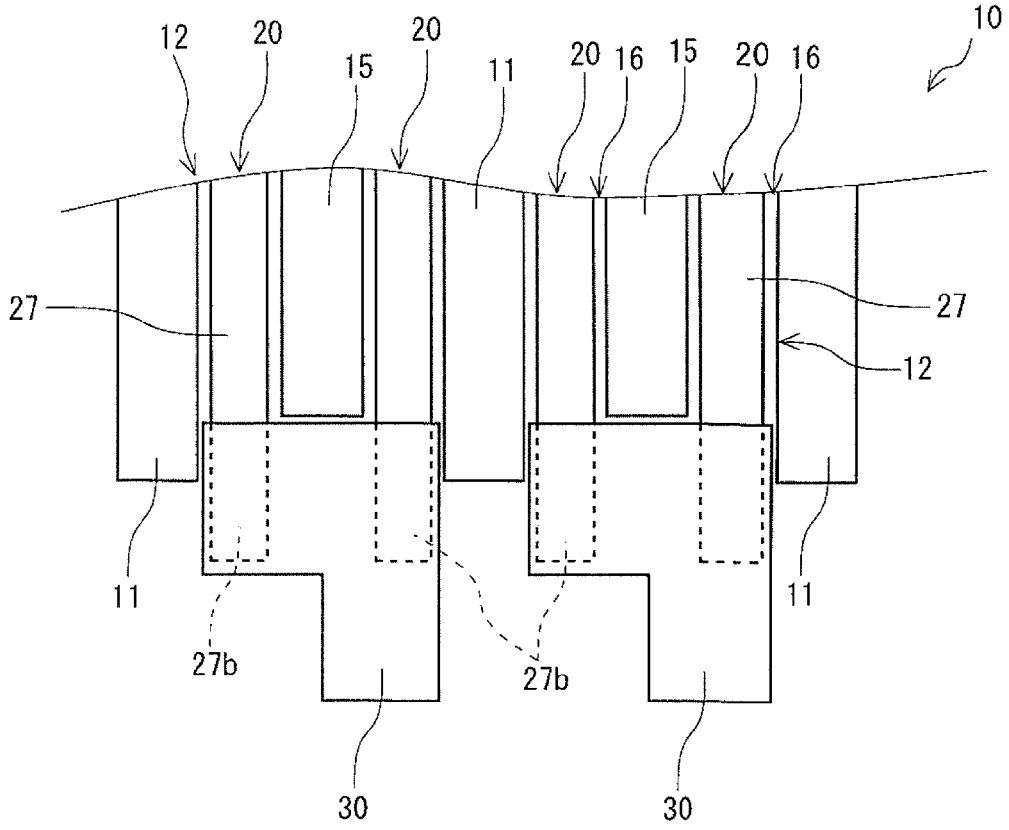
FIG. 2 is a schematic enlarged view of a main part, illustrating a vicinity of a rear end of knitting needles arranged on the needle bed of the weft knitting machine of FIG. 1, viewed from the normal direction of the needle bed.

As shown in FIGS. 1 and 2, the weft knitting machine 1 further comprise a needle bed 10 having a plurality of needle grooves 12 that store the knitting needles 20 respectively. The needle bed 10 is provided on a front side and a rear side, and the pair of needle beds 10 are arranged so as to have a cross section substantially in an inversed V shape, with an interval as a tooth opening between tip ends (upper ends) thereof (not illustrated).

(Needle Plate and Partitioning Plate)

On the above-mentioned needle bed 10, a plurality of needle plates 11 is provided upright and substantially parallel at regular intervals, and a gap between the needle plates 11 functions as the needle groove 12. In addition, on the needle bed 10, a partitioning plate 15 is provided upright between the needle plates 11, substantially parallel to the needle plate 11. The partitioning plate 15 partitions the needle groove 12 into two knitting needle storage regions 16. Each of the knitting needles 20 is stored in the respective knitting needle storage region 16 partitioned by the partitioning plate 15. Therefore, each needle groove 12 stores a plurality (two) of the knitting needles 20. Furthermore, a plurality of grooves are carved on the needle bed 10 (not illustrated) and the needle plate 11 and the partitioning plate 15 are inserted into the grooves, to thereby provide the needle plate 11 and the partitioning plate 15 upright on the needle bed 10.

The partitioning plate 15 is configured to have a length in a longitudinal direction smaller than that of the needle plate 11. In addition, a rear end (an end on an opposite side to the tip end of the knitting needle 20) of the partitioning plate 15 is positioned more on the tip end side than a rear end of the needle plate 11. Meanwhile, a front end (an end on a side of the tip end of the knitting needle 20) of the needle plate 11 and a front end of the partitioning plate 15 are positioned at the same position in the longitudinal direction. The selector 30 of the needle selection mechanism which is described below is interposed between the needle plates 11 at the rear end of the needle plates 11. The partitioning plate 15 is arranged such that the rear end thereof does not come into contact with the selector 30.

<Knitting Needle>

Figure 3:
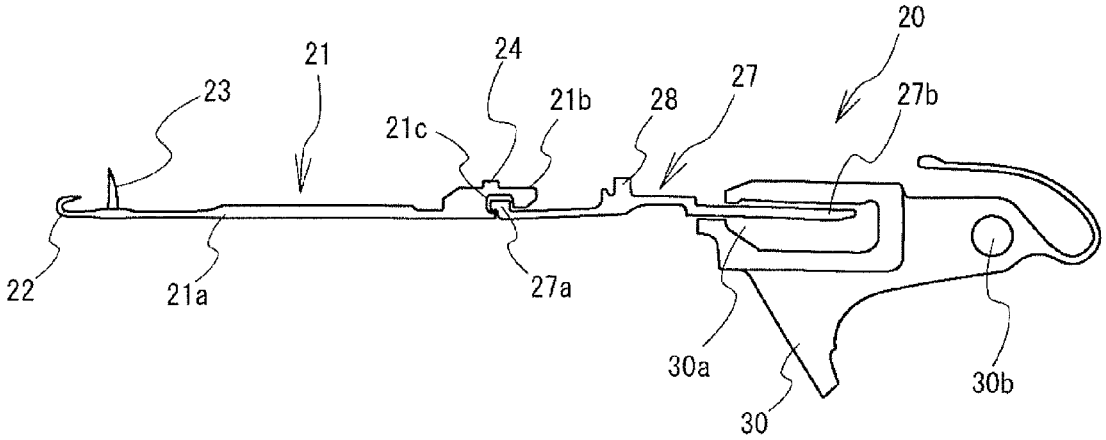
FIG. 3 is a schematic side view, which is a schematic illustrational view of a knitting needle and a selector used in the weft knitting machine of FIG. 1.

As shown in FIGS. 1 and 3, the knitting needle 20 has protruding butts 24, 28 that are to slide along the cam grooves 47, 48. As the butts 24, 28 slide along the cam grooves 47, 48, the knitting needle 20 reciprocates along the needle groove 12 (the knitting needle storage region 16 partitioned by the partitioning plate 15) thereby realizing the knitting operation by the knitting needle 20.

Figure 4:
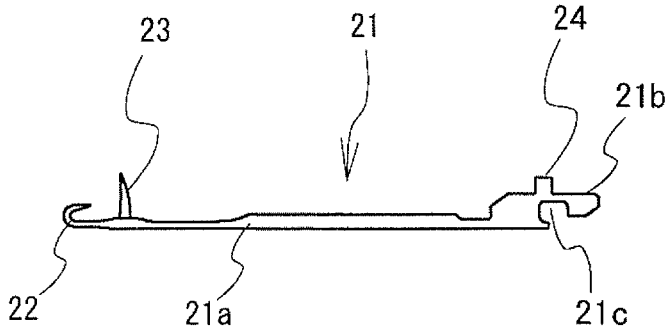
FIG. 4 is a schematic illustrational view of a stem of the knitting needle used in the weft knitting machine of FIG. 1, in which (A) is a schematic side view of a stem with a taller stem butt and (B) is a schematic side view of a stem with a shorter stem butt.
Figure 4:
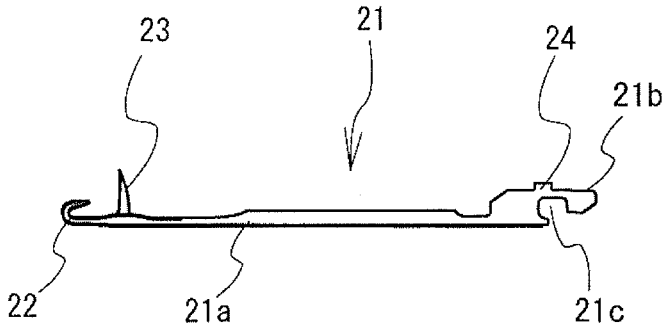

Each knitting needle 20 has a hook 22. More specifically, the knitting needle 20 has a stem 21 and a jack 27, the stem 21 having the hook 22 on a tip end thereof and the jack 27 being connected to the stem 21 and in contact with the selector 30. As shown in FIGS. 3 and 4, the stem 21 has a shaft portion 21*a* with the hook 22 formed on a tip end thereof and a connection portion 21*b* that is provided on a rear end side of the shaft portion 21*a* to be connected to the jack 27. The connection portion 21*b* of the stem 21 has an upper end higher than that of the shaft portion 21*a* and is configured to have a greater vertical width than the shaft portion 21*a*. Below the connection portion 21*b*, an engaging concave portion 21*c* is formed. In addition, the connection portion 21*b* has a stem butt 24 which is among the above-mentioned butts.

The jack 27 has a connection portion on a tip end thereof to connect with the stem 21. As shown in FIG. 3, the connection portion of the jack 27 is provided with an engaging convex portion 27*a* that protrudes upward and engages with the engaging concave portion 21*c* of the stem 21. By engaging the engaging concave portion 21*c* with the engaging convex portion 27*a*, the hook 22 and the jack 27 integrally reciprocate in the needle groove 12 (in the knitting needle storage region 16 partitioned by the partitioning plate 15). In addition, the rear end 27*b* of the jack 27 is attached to an after-mentioned concave portion 30*a* of the selector 30 so as to be insertable and removable in the longitudinal direction of the knitting needle 20. In addition, in an intermediate part of the jack 27 between the connection portion 27*a* and the rear end portion 27*b*, a jack butt 28 which is among the above-mentioned butts is formed. In other words, in the present embodiment, the knitting needle 20 has two butts 24 and 28 (the stem butt 24 and the jack butt 28) in the longitudinal direction.

The jack butt 28 is configured to have substantially the same height in all the knitting needles 20. On the other hand, the stem butt 24 is configured to have a height different from that of the butts 24, 28 of an adjacent knitting needle 20. More specifically, the plurality of knitting needles 20 is such that one having a taller stem butt 24 as shown in FIG. 4 (A) and one having a shorter stem butt 24 as shown in FIG. 4 (B) are arranged alternately. In other words, two knitting needles 20 disposed between a pair of needle plates 11 are configured such that the stem butt 24 of the first one is taller and the stem butt 24 of the second one is shorter. The taller stem butt 24 has a height to slide along an after-mentioned height selection portion 47*a* and the shorter stem butt 24 has a height not to slide along the height selection portion 47*a*. However, the configuration of the stem butt 24 is not particularly limited as long as improper contact with other components (for example, a bottom part of the cam groove 47 described later) can be avoided. Similarly, a ratio of the shorter stem butt 24 to the taller stem butt 24 is not particularly limited as long as the above-mentioned effect can be provided; however, the ratio can be at least 0.3 and no greater than 0.7.

In the present embodiment, a latch needle is employed as the knitting needle 20. The latch needle has a tip end that is curved in a hooked shape to form the hook 22, and a latch 23 that is pivotally attached thereto so as to open and close an opening part of the hook 22 (see FIG. 4). In a state in which the latch 23 opens the hook 22, the hook can catch a main thread or a rubber thread; and, in a state in which the opening part of the hook 22 is closed with the latch 23, the main thread or the rubber thread thus caught can be prevented from being released unintentionally. The latch 23 is configured to open the opening part of the hook 22 when the knitting needle 20 is moving toward the main thread or the rubber thread (during a forward movement of reciprocation) and to close the opening part of the hook 22 when the knitting needle 20 is retracting toward the needle bed 10 (during a backward movement of reciprocation).

<Needle Selection Mechanism>

The needle selection mechanism is designed to control the knitting needle 20 performing the knitting operation. The needle selection mechanism controls sliding of the butts 24, 28 of the knitting needle 20 along the cam grooves 47, 48 by moving the knitting needle 20 up and down, to thereby control the knitting operation of each knitting needle 20 according to a knitting method of a selected course. The needle selection mechanism is provided with the selector 30 that swings to lift the knitting needle 20 (moves to the side where the butts 24, 28 are protrudingly provided). The selector 30 is a plate-like member. As shown in FIG. 3, the selector 30 has a concave portion 30*a* on a front end side, the concave portion 30*a* storing a rear end of the knitting needle 20 (a rear end of the jack 27) in such a way that the rear end can be inserted and removed in the longitudinal direction of the knitting needle 20 and the knitting needle 20 which has been lifted can swing. In the concave portion 30*a* of one selector 30 stores a plurality of knitting needles 20. More specifically, the rear end 27*b* of two knitting needles 20 that are stored in one needle groove 12 (that are disposed between a pair of needle plates 11) is stored in the concave portion 30*a*. The pair of knitting needles 20 is thus lifted upward as one selector 30 swings. The selector 30 has a through hole 30*b* which allows the selector 30 to be pivotally attached to a swing shaft (not illustrated) provided in a main frame (not illustrated) of the weft knitting machine 1.

In addition, the needle selection mechanism has a needle selection drum (not illustrated) with a pin attached at a desired position on an outer periphery thereof. The selector 30 swings the knitting needle 20 upward in a state of being in contact with the pin on the needle selection drum. A conventionally known drum can be employed as the needle selection drum. More specifically, the needle selection drum can be configured with a rotator having a plurality of grooves formed in an axial direction on an outer periphery thereof and the above-mentioned pin that is detachably fixed to the groove at a desired position on the rotator. The rotator is configured to rotate in a circumferential direction according to a pitch of the grooves on the outer periphery thereof. Therefore, when the selector 30 is in contact with the pin of the needle selection drum, the selector 30 swings so as to lift the knitting needle 20 upward, so that the butts 24, 28 of the knitting needle 20 slide along the cam grooves 47, 48. On the other hand, when the selector 30 is not in contact with the pin of the needle selection drum, the knitting needle 20 remains in a state of being placed on a bed surface of the needle bed 10, so that the butts 24, 28 of the knitting needle 20 does not slide along the cam grooves 47, 48. The selector 30 is constantly biased toward the needle selection drum by a rotative force so as to prevent the knitting needle 20 from being unintentionally disconnected from the needle groove 12.

<Gauge>

In the weft knitting machine 1, the knitting needles 20 and the needle selection mechanism are arranged in such a way that a glove to be produced is of 26 gauges. More specifically, the knitting needles 20 are configured to correspond to 26 gauges and the needle selection mechanism is configured to correspond to 13 gauges, a half of 26 gauges. In addition, the knitting needles 20 are preferably configured to correspond to at least 16 gauges, more preferably to at least 20 gauges, and particularly preferably to at least 26 gauges. The gauge smaller than the above specified lower limit can make the produced glove too thick and therefore poor in fit to a hand.

<Carriage>

Figure 5:
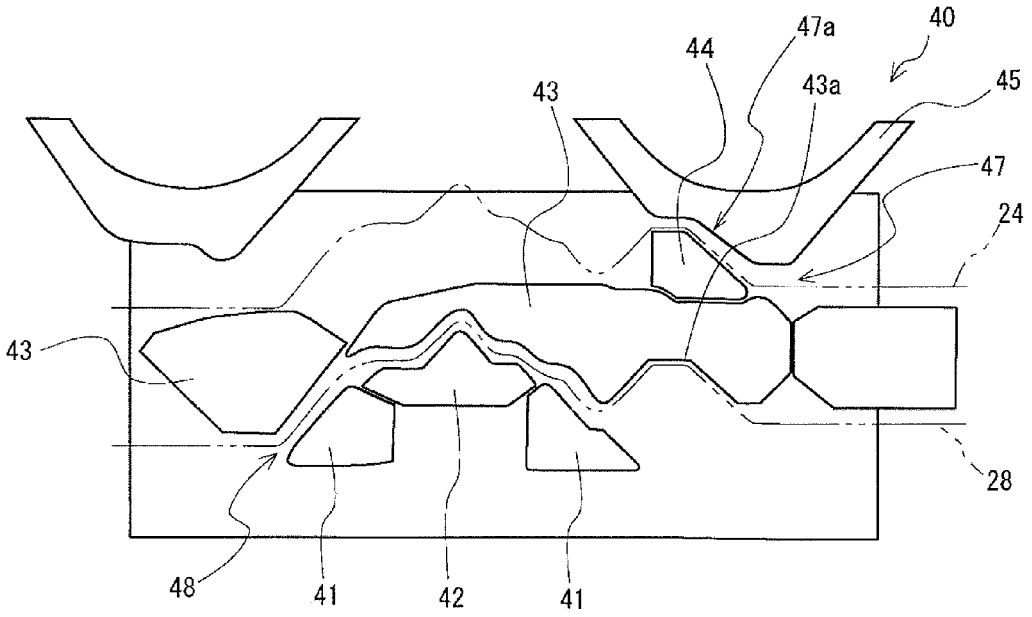
FIG. 5 is a schematic illustrational view of a carriage used in the weft knitting machine of FIG. 1 viewed from the needle bed side, in which trajectories of butts in a case in which the stem butt passes through a height selection portion of a first cam are indicated by dashed-dotted lines (the upper line in the diagram indicating a trajectory of the stem butt and the lower line indicating a trajectory of a jack butt)
Figure 6:
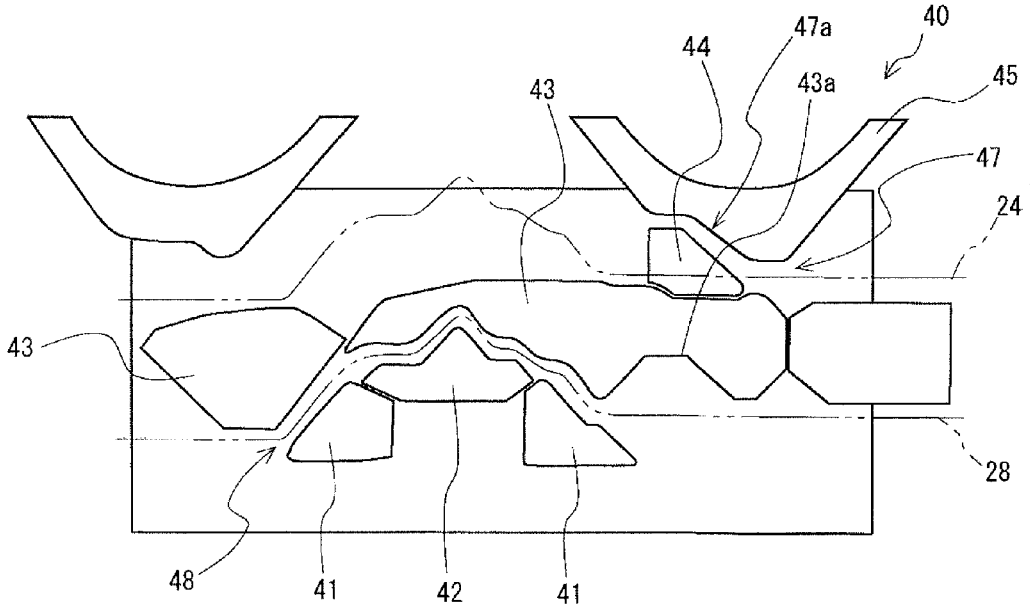
FIG. 6 is a schematic illustrational view of a carriage used in the weft knitting machine of FIG. 1 viewed from the needle bed side, in which trajectories of butts in a case in which the stem butt does not pass through the height selection portion of the first cam are indicated by dashed-dotted lines (the upper line in the diagram indicating a trajectory of the stem butt and the lower line indicating a trajectory of the jack butt)

The carriage 40 is provided to be reciprocable along a direction of arrangement of the plurality of knitting needles 20, on an upper side of the needle bed 10 in a normal direction. As shown in FIGS. 5 and 6, the carriage 40 includes a raising cam 41, a center cam 42, a lowering cam 43, a rubber thread stitch cam 44, and a side cam 45 provided on a face thereof opposite to the needle bed 10. In addition, in the carriage 40, the above-mentioned cam grooves 47 and 48 are formed on the face thereof opposite to the needle bed 10 by these cams 41 to 45, in such a manner that the butts 24, 28 of the knitting needle 20 slide in the cam grooves 47, 48 according to reciprocation of the carriage 40. Furthermore, the cam grooves 47, 48 of the carriage 40 are composed of a first cam groove 47 corresponding to the stem butt 24 of the knitting needle 20 and a second cam groove 48 corresponding to the jack butt 28.

The first cam groove 47 is a groove in which the stem butt 24 slides, and has a height selection portion 47*a* that allows only the taller stem butt 24 to slide while not allowing the shorter stem butt 24 to slide. More specifically, the rubber thread stitch cam 44 in the carriage 40 is provided to be operable to protrude from a bottom face of the first cam groove 47 toward the needle bed 10, and when the rubber thread stitch cam 44 is in a protruding state toward the needle bed 10, the rubber thread stitch cam 44 forms the above-mentioned height selection portion 47*a*. In other words, the rubber thread stitch cam 44 is configured to be protrudable from the bottom face of the first cam groove 47 by, for example, one-third to two-thirds of a depth of the first cam groove 47. Therefore, only the taller stem butt 24 slides on a cam face of the rubber thread stitch cam 44 in the protruding state and the shorter stem butt 24 does not engage with (slide on) the rubber thread stitch cam 44. In addition, with the rubber thread stitch cam 44 in the protruding state, every other knitting needle 20 (the knitting needle having the taller stem butt 24) performs the knitting operation, in other words reciprocates in the longitudinal direction of the knitting needle 20. However, in a non-protruding state of the rubber thread stitch cam 44, neither of the shorter stem butt 24 nor the taller stem butt 24 slides thereon.

The second cam groove 48 is a groove in which the jack butt 28 slides. The second cam groove 48 realizes the knitting operation of the knitting needles 20, in other words advances the knitting needle 20 in the longitudinal direction thereof, by the raising cam 41. In addition, the second cam groove 48 further advances the knitting needle 20 that has thus been advanced for knitting by the raising cam 41. The second cam groove 48 then retracts the advanced knitting needle 20 by the lowering cam 43.

The first cam groove 47 and the second cam groove 48 are formed not to prevent one another to guide the knitting needle 20 when any one of these guides the knitting needle 20 (makes the butts 24, 28 slide therein). More specifically, the height selection portion 47*a* of the first cam groove 47 is arranged at a different position in a running direction of the carriage 40 from a position of a part performing the knitting operation of the knitting needle 20 according to the raising cam 41 and the center cam 42 of the second cam groove 48. In addition, as shown in FIG. 5, the lowering cam 43 composing the second cam groove 48 has a notch 43*a* formed thereon that allows the jack butt 28 of the knitting needle 20 moves when the knitting needle 20 rises at the height selection portion 47*a*. The notch 43*a* on the lowering cam 43 also functions to retract the knitting needle 20 that has been advanced by the rubber thread stitch cam 44.

In addition, the lowering cam 43 is configured to retract the knitting needle 20 as the jack butt 28 slides on a lower face thereof, while preventing excessive retraction of the knitting needle 20 as the stem butt 24 is in contact with an upper face thereof. In addition, the lowering cam 43 and the raising cam 41 can be provided to be advanceable and retractable between the bottom face of the carriage 40 (bottom face of the cam groove) and the needle bed 10. This configuration can allow the knitting needle 20 to perform the knitting operation in a forward movement, and to maintain the knitting needle 20 at a desired position in a backward movement.

[Method for Manufacturing Glove]

A method for manufacturing a glove using the weft knitting machine 1 having the above described configuration is described hereinafter.

A main thread used in the method for manufacturing a glove can be, for example, a long fibered thread. However, the thread is not limited to the long fibered thread and various threads can be employed. For example, the glove can also be composed of a short fibered thread such as a cotton thread. The thickness of the thread used is preferably at least 11 dtex and no greater than 385 dtex, and more preferably at least 33 dtex and no greater than 308 dtex. The thickness smaller than the above specified lower limit makes handling of the thread difficult, which may lead to an increased manufacturing cost. The thickness greater than the above specified upper limit makes the thread too thick, which may prevent knitting with desired gauge.

The method for manufacturing a glove comprises: a glove main body knitting process of knitting a glove main body with a finger sheath and a body pocket; and an inlaid knitting process of knitting by inlaid knitting a tube-like elastic portion corresponding to a wrist of a wearer. The finger sheath is a sheath-like part that receives a finger of the wearer and the body pocket is a pocket-like part that receives a back of hand of the wearer. For example, a pinky finger sheath, a ring finger sheath, a middle finger sheath, an index finger sheath, and a thumb sheath are continuously provided as the finger sheath from the body pocket. In such a glove, generally, the pinky finger sheath, the ring finger sheath, the middle finger sheath, the index finger sheath, a three finger body as the body pocket, a four finger body as the body pocket, and then a five finger body as the thumb sheath as well as the body pocket are sequentially formed.

In the glove main body knitting process, the rubber thread stitch cam 44 is in the non-protruding state and the knitting needle 20 performs the knitting operation as the jack butt 28 slides along the second cam groove 48 as shown in FIG. 6, thereby forming stitch loops. Here, desired knitting is performed by selecting the knitting needle 20 for performing the knitting operation by the needle selection mechanism. Moreover, in the weft knitting machine 1, a pair of knitting needles 20 is moved up and down by one of the selector 30 in the needle selection mechanism.

In the inlaid knitting process, the rubber thread stitch cam 44 is in the protruding state. In the inlaid knitting process, a rubber thread engaging step of engaging a rubber thread with the hook 22 of every other knitting needle 20 (the knitting needle 20 with the taller stem butt) and a stitch loop forming step of forming a stitch loop with the main thread are alternately performed.

More specifically, as the taller stem butt 24 of the knitting needle 20 swung upward by the needle selection mechanism slides along the height selection portion 47*a* of the first cam groove 47 formed by the rubber thread stitch cam 44 in the protruding state as shown in FIG. 5, only the knitting needle 20 having this taller stem butt 24 performs the knitting operation and the rubber thread is engaged only with the hook 22 of the knitting needle 20 having the taller stem butt 24 (the rubber thread engaging step). Thereafter, as the jack butt 28 of the knitting needle 20 swung upward by the needle selection mechanism slides along the second cam groove 48, the knitting needle 20 with the rubber thread engaged with the hook 22 thereof and the knitting needle 20 having the shorter stem butt 24 disposed between the knitting needles 20 in such an engagement state perform the knitting operation, to thereby form the stitch loops with the main thread (the stitch loop forming step). The stitch loops thus formed are in a state in which the rubber thread passes through every other stitch loop. By repeating the rubber thread engaging step and the stitch loop forming step, the elastic portion of the glove is formed by inlaid knitting.

[Advantages]

In the weft knitting machine 1 having the above described configuration, since the selector 30 can simultaneously raise two knitting needles 20, which are stored in one needle groove 12, two adjacent knitting needles 20 can be operated simultaneously to perform the knitting operation by making the jack butt 28 thus raised slide along the second cam groove 48. Therefore, a fine stitched glove of high gauge can be manufactured easily and reliably while effectively preventing increase in the number of components in the needle selection mechanism such as the selector 30. A thin glove which is superior in texture and cost effective can thus be manufactured.

In addition, as only the taller butt of the stem butts 24 of the knitting needles being raised slides along the height selection portion 47*a* of the first cam groove 47, the rubber thread can be engaged only with the hook 22 of the knitting needle 20 having the taller butt. Inlaid knitting can thus be performed easily and reliably, thereby allowing knitting of the elastic portion of the glove easily and reliably.

Furthermore, since the needle groove 12 is partitioned into two knitting needle storage regions 16 by the partitioning plate 15, and since one knitting needle 20 is stored in each knitting needle storage region 16, the knitting needle 20 can stably be operated to reciprocate (knitting operation). In addition, since the selector 30 and the partitioning plate 15 are arranged not to be in contact with each other, the selector 30 can simultaneously raise two knitting needles 20 in one needle groove 12 easily and reliably. Moreover, since the selector 30 is disposed between the needle plates 11, the selector 30 can be easily swung.

In addition, since the knitting needle 20 has only one hook 22, manufacture of the knitting needle 20 is easier and less costly compared to, for example, a knitting needle having a plurality of hooks, thereby contributing to reduction in the manufacturing cost. Furthermore, since the knitting needle 20 is provided with the stem 21 having the hook 22 and the jack 27 connected to the stem 21, the knitting needle 20 used in the present weft knitting machine 1 can be obtained by combining the stem 21 and the jack 27, which are conventionally available products. This can reduce a cost of the weft knitting machine 1 itself.

[Other Embodiments]

It should be noted that, in addition to the above described embodiment, the present invention can be embodied with various modifications and improvements.

More specifically, in the above described embodiment, one needle groove 12 storing two knitting needles 20 has been described, however, the present invention is not limited thereto, and design can be modified as appropriate, for example, to store three or more knitting needles in one needle groove. Furthermore, in such a case of storing three or more knitting needles in one needle groove, it is preferable that the needle groove is partitioned to three or more by two or more partitioning plates, and each knitting needle storing region stores one knitting needle. In other words, it is preferable to partition the needle groove by the partitioning plates such that the number of knitting needle storing regions formed corresponds to the number of knitting needles to be stored in the needle groove.

Figure 7:
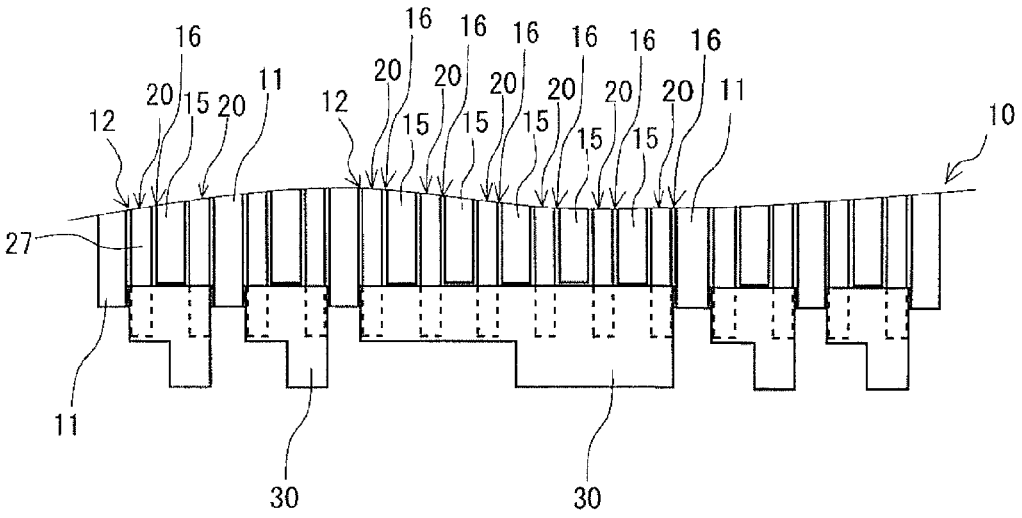
FIG. 7 is a schematic enlarged view of a main part, illustrating a vicinity of a rear end of knitting needles arranged on the needle bed of a weft knitting machine according to an embodiment different from FIG. 1, viewed from the normal direction of the needle bed.
Figure 8:
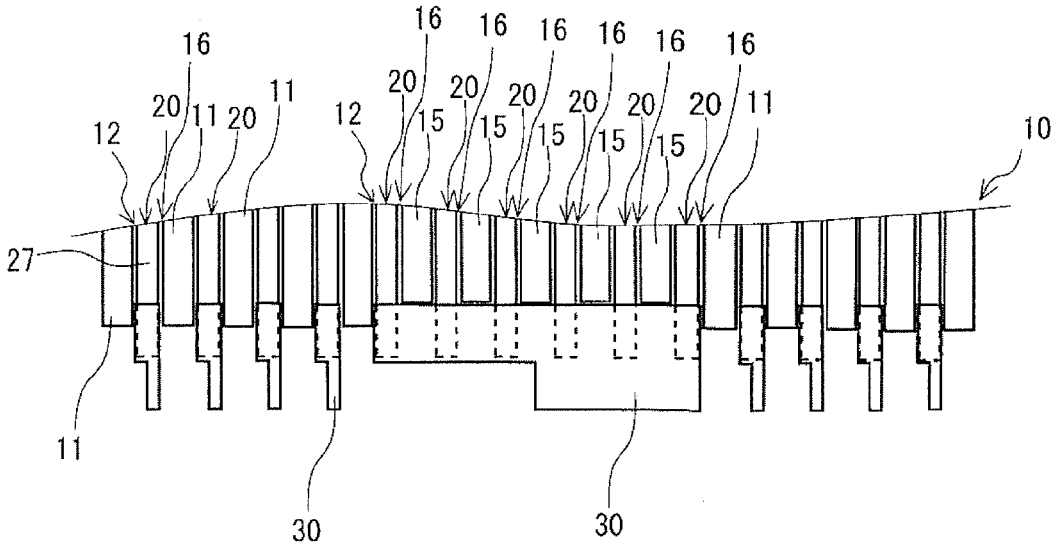
FIG. 8 is a schematic enlarged view of a main part, illustrating a vicinity of a rear end of knitting needles arranged on the needle bed of a weft knitting machine according to an embodiment different from FIG. 1 and FIG. 7, viewed from the normal direction of the needle bed.

More specifically, as shown in FIG. 7, a configuration in which six knitting needles 20 are stored in one needle groove 12, which is partitioned into six knitting needle storage regions 16 by five partitioning plates 15, is also within an intended scope of the present invention. The knitting machine illustrated in FIG. 7 is configured such that six knitting needles 20 stored in one needle groove 12 are moved by one selector 30 toward a side of the butt protruding. While, in the knitting machine illustrated in FIG. 7, the needle grooves 12 except for the needle groove 12 storing the six knitting needles 20 store two knitting needles 20 respectively, as in the above described embodiment, the present invention is not limited thereto. In other words, for example as shown in FIG. 8, a configuration in which the needle grooves 12 except for the needle grooves 12 storing a plurality of knitting needles 20 respectively store one knitting needle 20 is also within an intended scope of the present invention. In addition, in a case of storing one knitting needle in one needle groove, it is possible to use a knitting needle with a plurality of hooks as disclosed in the above-mentioned Japanese Unexamined Patent Application Publication No. 2012-12757.

Furthermore, in the above described embodiment, a configuration in which the knitting needle 20 having the taller stem butt 24 and the knitting needle 20 having the shorter stem butt 24 are arranged alternately and the first cam groove 47 has the height selection portion 47*a* has been described, however, the present invention is not limited thereto.

In other words, the present invention does not have to be provided with the knitting needle with the shorter butt. More specifically, for example, a configuration can be employed in which the knitting needle with the shorter stem butt in the knitting machine of the above described embodiment is replaced with a knitting needle without a stem butt. That is, it is possible to provide a selective butt such as the taller stem butt of the above described embodiment on a knitting needle, so that the selective butt is slidable along a selective part that is selectively formed in a cam groove by an operation, such as the height selection portion that is formed by a protruding operation of the rubber thread stitch cam 44 as in the above described embodiment, and to arrange a knitting needle with the selective butt and a knitting needle without the selective butt alternately. Furthermore, in this case, the rubber thread stitch cam for formation of the selective part in the cam groove does not have to protrude by the height as in the above described embodiment, and can also be configured to protrude to the same height as other cams.

In addition, the selective part (height selection portion) in the cam groove as described above is not limited to one formed in the first cam groove 47 and it is a matter of appropriate design change to form the selective part in the second cam groove 48. Furthermore, in this case, the jack butt can be used as the above described selective butt. However, in a case in which the jack butt is configured to slide along the cam groove upon formation of knitted loops as described above, it is preferable to provide the height selection portion 47*a* in the first cam groove 47 along which the stem butt 24 slides as in the above described embodiment, in order to prevent the shorter jack butt from being quickly worn and depleted.

Furthermore, in a case in which three or more knitting needles 20 are stored in one needle groove 12 as described above, it is a matter of appropriate design change for example, to provide two knitting needles among three knitting needles in one needle groove with taller butts (selective butts) having a height equal to each other and taller than the butt of other one knitting needle, to provide two knitting needles with butts having a height equal to each other and shorter than the butt of other one knitting needle (a butt with the selective butt), or to provide the three knitting needles with butts having different heights.

However, it is preferable that, as to the plurality of knitting needles 20 arranged in the needle bed 10, the knitting needle 20 with the taller butt 24 and the knitting needle 20 with the shorter butt 24 are alternately arranged as in the above described embodiment, to thereby form the elastic portion, in which the rubber thread passes through every other stitch loop, easily and reliably. However letting the rubber thread pass through every other stitch loop is not an obligatory requirement. For example, it is possible to dispose two or more knitting needles with the shorter butts between the knitting needles with the taller butts, in other words, it is a matter of appropriate design change to arrange the knitting needles with the selective butts at intervals of several knitting needles. Alternatively, for example, knitting can be performed in such a way that the rubber thread passes through two consecutive stitch loops and skips the subsequent stitch loop. In other words, by changing an arrangement pattern of the knitting needles with the taller butt (selective butt) and the knitting needles with the shorter butt (knitting needle without the selective butt), a desired knitting method can be realized.

In addition, in the above described embodiment, the knitting needle 20 having the stein 21 with the hook 22 and the jack 27 that is detachably connected to the stem 21 has been described, however, the present invention is not limited thereto and it is a matter of appropriate design change to use, for example, a knitting needle in which shapes of the stein and the jack are integrally formed, in the above described embodiment.

Furthermore, in the above described embodiment, the knitting needle 20 having the stem butt 24 and the jack butt 28, in other words the knitting needle 20 having two types of butts 24, 28 in the longitudinal direction has been described. However, the present invention is not limited thereto and a knitting needle having the same type of butts in the longitudinal direction in which the butts are different in height from butts of other knitting needles is also within the intended scope of the present invention.

However, it is preferable, as in the above described embodiment, to configure the knitting needle 20 to have the stem 21 with the hook 22 and the jack 27 that is detachably connected to the stem 21, the jack 27 being provided with the jack butt 28, which slides along the cam grooves 47, 48 upon formation of knitted loops. Such a configuration has an advantage in reduction of running cost because, in a case of breakage or the like of the jack butt 28 which slides along the cam grooves 47, 48 upon formation of stitch loops, only the jack butt 28 can be replaced for repair.

In addition, in the above described embodiment, the cam grooves composed of the first cam groove 47 along which the stem butt 24 slides and the second cam groove 48 along which the jack butt 28 slides have been described, however, the present invention is not limited thereto.

Furthermore, in the above described embodiment, a method for manufacturing a glove using a knitting machine has been described, however, the knitting machine can also be used for a method for manufacturing a knitted product other than a glove.

Moreover, in the above described embodiment, a latch needle employed as the knitting needle 20 has been described, however, the present invention is not limited thereto and a crochet needle, a spring bearded needle, a double pointed needle and the like can also be employed as the knitting needle 20.

INDUSTRIAL APPLICABILITY

As described above, the weft knitting machine of the present invention is capable of: performing a desired knitting method such as inlaid knitting easily and reliably; and manufacturing a thin glove which is superior in texture and cost effective, and can be preferable used for manufacture of a glove, for example.

EXPLANATION OF REFERENCE NUMERALS

1 Weft knitting machine
10 Needle bed
11 Needle plate
12 Needle groove
15 Partitioning plate
16 Knitting needle storage region
20 Knitting needle
21 Stem
21*a* Shaft portion
21*b* Connection portion
21*c* Engaging concave portion
22 Hook
24 Stem butt
27 Jack
27*a* Engaging convex portion
27*b* Rear end portion
28 Jack butt
30 Selector
30*a* Concave portion
40 Carriage
41 Cam
42 Center cam
43 Cam
43*a* Notch
44 Rubber thread stitch cam
45 Side cam
47 First cam groove
47*a* Height selection portion
48 Second cam groove

What is claimed is:

1. A method of manufacturing a knitted product, the method comprising:

providing a knitting machine comprising:

a plurality of knitting needles each of which has a protrudingly provided butt and which are arranged substantially parallel to each other so as to be able to perform a knitting operation independently;

a plurality of selectors that move the plurality of knitting needles to a side where the protrudingly provided butt is protrudingly provided;

a carriage having a cam groove along which the protrudingly provided butt of the plurality of knitting needles moved by the plurality of selectors to the side where the protrudingly provided butt is protrudingly provided can slide;

a plurality of needle plates that are provided substantially parallel to each other and that constitute needle grooves; and at least one partitioning plate that is provided between a pair of the plurality of needle plates to be substantially parallel to the plurality of needle plates, wherein:

each of the plurality of knitting needles is stored in a portion partitioned by the at least one partitioning plate so as to be able to perform a knitting operation;

each of the plurality of selectors is provided between the pair of the needle plates in such a way as not to be in contact with the at least one partitioning plate; and one of the plurality of selectors simultaneously moves two adjacent needles within each of the needle grooves for operation with the protrudingly provided butt.

2. A method of manufacturing a glove, the method comprising:

providing a knitting machine comprising:

a plurality of knitting needles each of which has a protrudingly provided butt and which are arranged substantially parallel to each other so as to be able to perform a knitting operation independently;

a plurality of selectors that move the plurality of knitting needles to a side where the protrudingly provided butt is protrudingly provided;

a carriage having a cam groove along which the protrudingly provided butt of the plurality of knitting needles moved by the plurality of selectors to the side where the protrudingly provided butt is protrudingly provided can slide;

a plurality of needle plates that are provided substantially parallel to each other an that constitute needle grooves; and at least one partitioning plate that is provided between a pair of the plurality of needle plates to be substantially parallel to the plurality of needle plates, wherein:

each of the plurality of knitting needles is stored in a portion partitioned by the at least one partitioning plate so as to be able to perform a knitting operation;

each of the plurality of selectors is provided between the pair of the needle plates in such a way as not to be in contact with the at least one partitioning plate; and one of the plurality of selectors simultaneously moves two adjacent needles within each of the needle grooves for operation with the protrudingly provided butt.

3. The method of manufacturing a glove according to claim 2, the method further comprising an inlaid knitting process in which a rubber thread is carried by either every other knitting needle of said plurality of knitting needles or every several knitting needles of said plurality of knitting needles by letting a taller butt slide along a height selection portion in the cam groove.

* * * * *